US005708995A

United States Patent [19]

Wu et al.

[11] Patent Number: 5,708,995

[45] Date of Patent: Jan. 20, 1998

[54] VARIABLY INSULATED BLANKET

[76] Inventors: Yi-Ni Wu, 970 Medford Rd., Pasadena, Calif. 91107; James Cheng-Wah Loh, 8818 Emperor Ave., San Gabriel, Calif. 91775

[21] Appl. No.: 801,044

[22] Filed: Feb. 14, 1997

[51] Int. Cl.[6] ..... A47G 9/02

[52] U.S. Cl. ..... 5/486; 5/502

[58] Field of Search ..... 5/486, 502, 482, 5/500, 494

[56] References Cited

U.S. PATENT DOCUMENTS

| | | | |
|---|---|---|---|
| 2,350,363 | 6/1944 | Massa | 5/502 |
| 3,508,284 | 4/1970 | Marquette | 5/486 |
| 5,146,634 | 9/1992 | Hunt | 5/486 |
| 5,199,121 | 4/1993 | Payne | 5/502 |
| 5,243,725 | 9/1993 | Fowler | 5/502 |
| 5,299,333 | 4/1994 | Pedersen et al. | 5/502 |
| 5,408,712 | 4/1995 | Brun | 5/502 |
| 5,594,964 | 1/1997 | Boyd et al. | 5/502 |

FOREIGN PATENT DOCUMENTS

| | | | |
|---|---|---|---|
| 3305507 | 8/1984 | Germany | 5/502 |
| 662714 | 10/1987 | Switzerland | 5/502 |

*Primary Examiner*—Alexander Grosz
*Attorney, Agent, or Firm*—Goldstein & Associates

[57] ABSTRACT

A blanket, having a blanket head and a blanket foot. The blanket has a light side and a heavy side, both extending between the blanket head and blanket foot. The light side has a light side insulation thickness, and the heavy side has a heavy side insulation thickness. A transitional area is located between the light side and heavy side, the transitional area uniformly varies in insulation thickness between the light side insulation thickness and the heavy side insulation thickness. Straps present at the blanket foot and at the heavy side are present to secure the blanket to a bed frame.

5 Claims, 3 Drawing Sheets

VARIABLY INSULATED BLANKET

BACKGROUND OF THE INVENTION

The invention relates to a blanket. More particularly, the invention relates to a blanket in which the insulative properties are varied with respect to different areas of the blanket.

Blankets are used at bed-time year round. During sleep, the body is still, thus conserving heat is important. In cold weather, when the air temperature is well below the normal body temperature, a blanket is extremely important. Even in warm weather, a light blanket is used to keep the body at a slightly higher temperature than the surrounding air. But during warm weather, a thick "cold weather" blanket can be quite uncomfortable.

Often to conserve energy, the thermostat is lowered at night. Further, in some rural areas where homes have no central heat, the bedrooms or even the house itself is not adequately heated at night. Thus, the blanket becomes a necessary shield against the cold.

In all climates, the ambient temperature tends to drop during the night. Thus while a thin blanket might be comfortable at bedtime, later in the night it might become inadequate to keep warm later in the night. Because people do not wish to get up during the night to switch blankets, they often endure the cold for the remainder of the night. This, however, is not a wise decision, and often leads to sickness. Children are especially susceptible to becoming sick when they are not kept warm during the night. U.S. Pat. No. 5,199,121 to Payne discloses an adjustable fill comforter, in which the insulating material may be shifted internally. U.S. Pat. No. 5,243,725 to Fowler discloses a comforter having a stitch pattern intended to maintain a "puffed" appearance regardless of the thickness of the comforter. U.S. Pat. No. 5,408,712 to Brun discloses a comforter in which the fill material is concentrated in the center of the blanket rather than the fringes. The purpose of Brun is to avoid wasting fill material on areas of the blanket that are normally draped over the sides of the bed.

U.S. Pat. 5,299,333 to Pedersen et al. discloses a random flow down comforter with a restricted border region.

U.S. Pat. No. 5,146,634 to Hunt discloses a blanket having three distinct insulating zones. The insulating zones are oriented to provide a light insulation between the user's hips and shoulders, medium insulation between the hips and knees, and heavy insulation between the knees and feet. Because of the orientation of the insulating zones on the blanket, Hunt is unsuitable to cover the entire body with one of the zones. The range of insulation is selected to accommodate the differences in body temperature between various areas along the length of the body. However, this temperature variation is always less than ten degrees Fahrenheit.

While these units may be suitable for the particular purpose employed, or for general use, they would not be as suitable for the purposes of the present invention as disclosed hereafter.

SUMMARY OF THE INVENTION

It is an object of the invention to produce a blanket having varied insulative properties which allow a person to find achieve a comfortable temperature for sleeping It is another object of the invention that the blanket provides a variation of insulation which allows the optimum temperature to be maintained as the ambient temperature drops.

It is a further object of the invention that the blanket is capable of securing to the bed, to allow the warmest area of the blanket to be maintained against a side edge of the bed.

The invention is a blanket, having a blanket head and a blanket foot. The blanket has a light side and a heavy side, both extending between the blanket head and blanket foot. The light side has a light side insulation thickness, and the heavy side has a heavy side insulation thickness. A transitional area is located between the light side and heavy side, the transitional area uniformly varies in insulation thickness between the light side insulation thickness and the heavy side insulation thickness. Straps present at the blanket foot and at the heavy side are present to secure the blanket to a bed frame.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
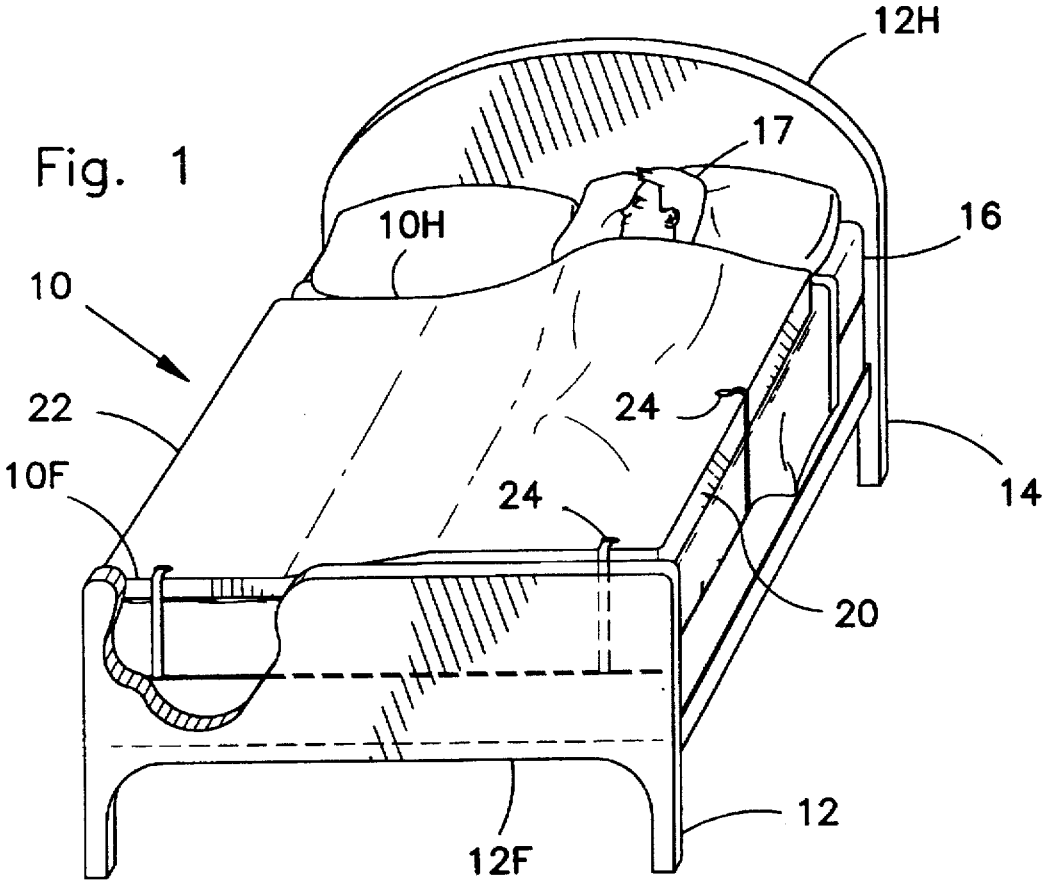
FIG. 1 is a diagrammatic perspective view, illustrating the blanket in use, and secured to a bed.

FIG. 1 illustrates a blanket 10 attached to a bed 12 having a bed frame 14, and a mattress 16 situated atop the bed frame 14. The bed 12 has a head 12H and a foot 12F. A person 17 is shown sleeping beneath the blanket 10.

The blanket 10 has a heavy side 20 and a light side 22. The blanket 10 also has a blanket head 10H which is normally positioned at the head 12H of the bed 12, and blanket foot 10F which is positioned at the foot 12F of the bed 12. Straps 24 are positioned at the heavy side 20 which secure the blanket 10 to the bed frame 14. The straps 24 are also positioned at the blanket foot 10F.

The straps 24 preferably secure the blanket 10 to the bed 12 when the blanket 10 is used with children. The straps 24 keep the blanket 10 properly oriented on the bed 12—preventing the children from rotating the blanket 10 during the night. The straps 24 ensure that the heavy side 20 of the blanket 10 stays secured to the bed 12, so that when the temperature drops significantly, the children will remain warm. Otherwise, children have the tendency to rotate the blanket 10 during the night, which would then keep their chest warm, but not adequately protect their legs, or vice versa.

Figure 2:
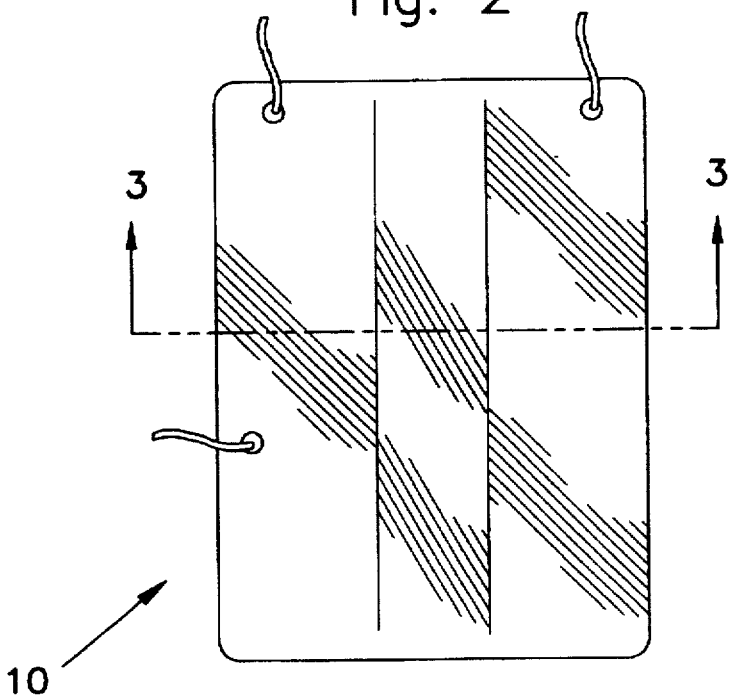
FIG. 2 is a top plan view of the blanket per se.

FIG. 2 shows the blanket 10 per se. Line 3—3 in FIG. 2 is a cutting plane line used to define the cross sectional views of FIG. 3A and alternatively 3B.

Figure 3A:
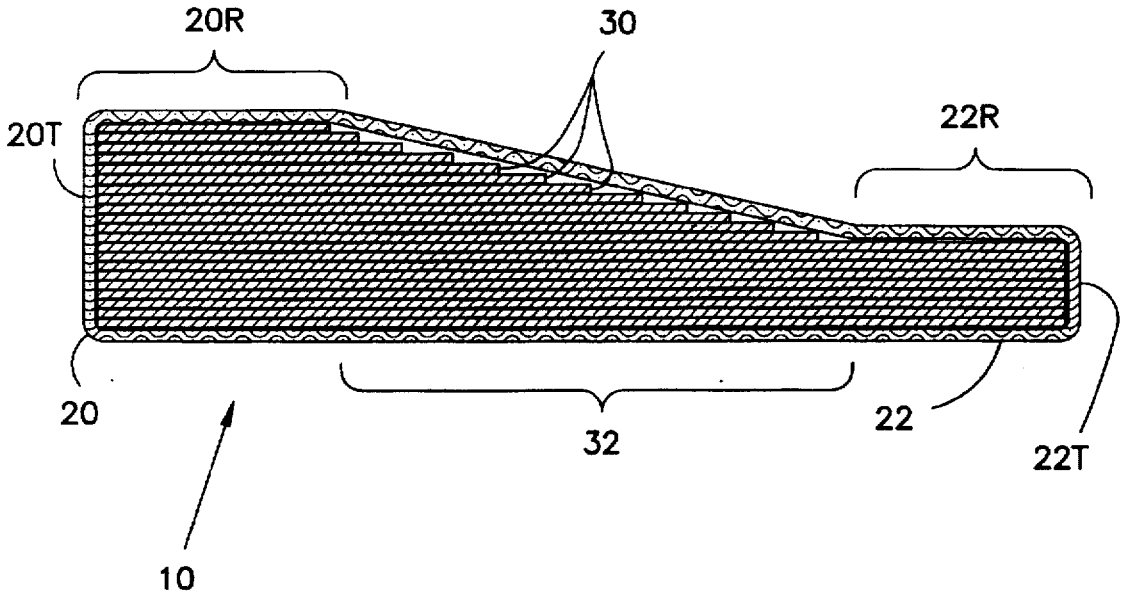
FIG. 3A is a cross sectional view taken along line 3—3 of the blanket.

FIG. 3A illustrates internal details of the blanket 10. In FIG. 3A, the blanket 10 is made of a plurality of stacked layers 30, each of which is a discrete layer of an insulating material, such as a natural or synthetic fabric, or a polyester foam sheet. The light side 22 has a light side insulative thickness 22T, which is the thickness of the blanket 10 at the light side 22. In addition, the heavy side 20 has a heavy side thickness 20T, which is the thickness of the blanket 10 at the heavy side 20. As illustrated, the light side 22 of the blanket 10 has less layers 30 than the heavy side 20. The light side 22 may have as few as one layer 30, and the heavy side 20 has between five and twenty five layers 30. Thus, the heavy side insulative thickness 20T is greater than the light side insulative thickness 22T. Therefore, greater insulation and thus warmth is present at the heavy side 20 than the light side 22. The relative thickness of the heavy side 20 and the light side 22 is chosen so that the heavy side 20 provides sufficient insulation for the human body when the temperature is thirty or forty degrees Fahrenheit colder than the temperature for which the light side 22 provides sufficient insulation.

Between the heavy side 20 and the light side 22 is a transitional area 32 which varies in thickness between the light side insulation thickness 22T and the heavy side insulation thickness 20T. The thickness in the transitional area 32 is uniformly varied by varying the width of consecutive layers 30, thus creating the stepped arrangement illustrated in FIG. 3A. The transitional area 32 creates a zone of increasing warmth. Thus, the person 17 sleeping under the blanket 10 can find a location under the blanket 10 which creates the maximum comfort. In addition, during the night, the person 17 can slowly move from the light side 22 toward the heavy side 20 as the temperature drops, without being either too cold or too hot at any time during the night. It is important to note that the insulation variations are oriented so that at any given point across the blanket, the insulation is uniform from blanket head to blanket foot.

Between the light side 22 and the transitional area 32 is a light region 22R. The light region 22R has a uniform thickness. Between the heavy side 20 and the transitional area 32 is a heavy region 20R. The heavy region 20R has a uniform thickness. In general, at any given point across the blanket 10, the blanket 10 has a uniform thickness between the blanket head 10H to the blanket foot 10F. Thus, the blanket 10 provides a consistent level of insulation to a person laying beneath the blanket—from head to toe.

Figure 4:
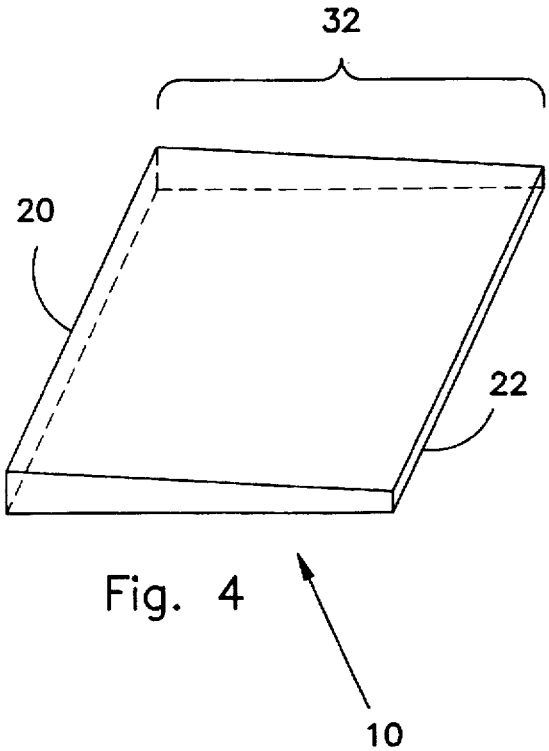
FIG. 4 is a diagrammatic perspective view showing an embodiment of the invention.

FIG. 4 through FIG. 7 illustrate different topologies for the blanket 10. FIG. 4 represents a topology in which the transitional area 32 extends the entire distance from the light side 22 to the heavy side 20. With the blanket 10 shown in FIG. 4, the blanket 10 is continuously variable across its entire width.

Figure 5:
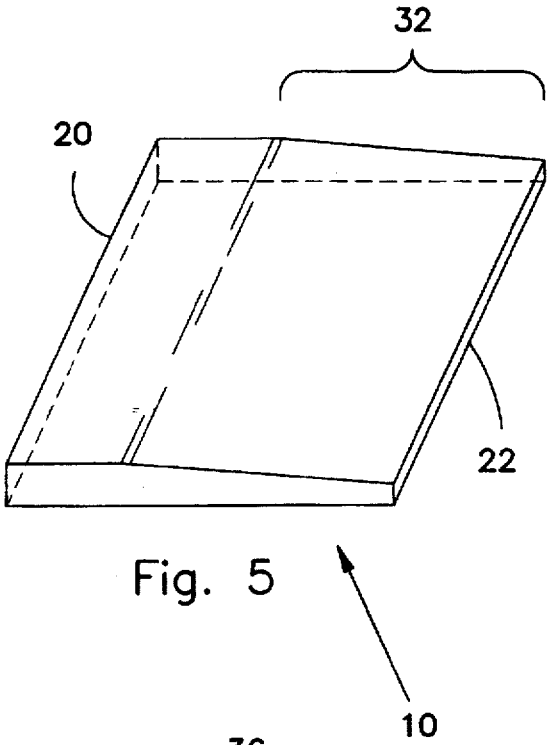
FIG. 5 is a diagrammatic perspective view showing another embodiment of the invention.

FIG. 5 illustrates a topology in which the transitional area 32 begins at the light side 22, and stops short of the heavy side 20, thus providing an area of constant, thick insulation.

Figure 6:
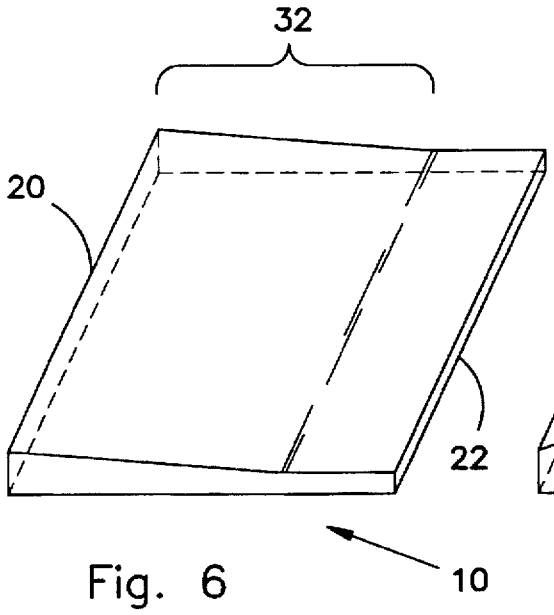
FIG. 6 is a diagrammatic perspective view showing a further embodiment of the invention.

FIG. 6 illustrates a topology which is the reverse of FIG 5. The blanket 10 has an area of constant thickness at the light side 22, and then the transitional area 32 extends to the heavy side 20.

Figure 7:
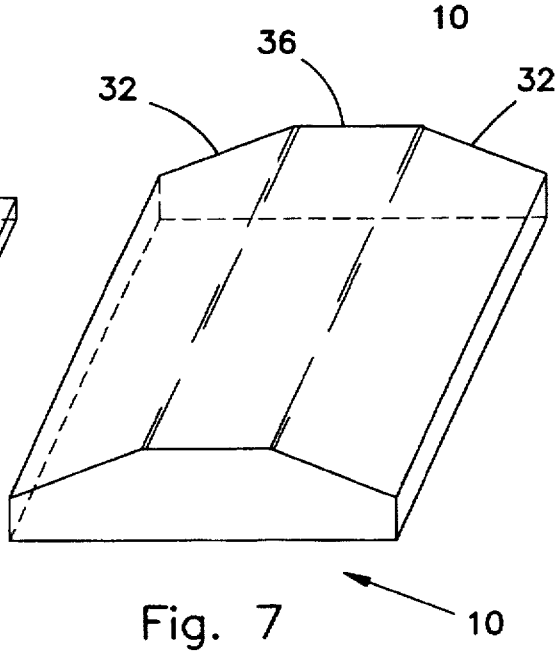
FIG. 7 is a diagrammatic perspective view showing a still further embodiment of the invention.

FIG. 7 illustrates a topology in which the blanket 10 has a thick central region 36, and has two transitional areas 32 extending outward from the central region 36. This topology is perhaps best suited for use by two people. When the temperature is warmer, each person will lay beneath one of the transitional regions 32 and find a location of maximum comfort. When it is colder, they will both move toward the center, where it will be warmer through a combination of increased insulation and body heat.

Figure 3B:
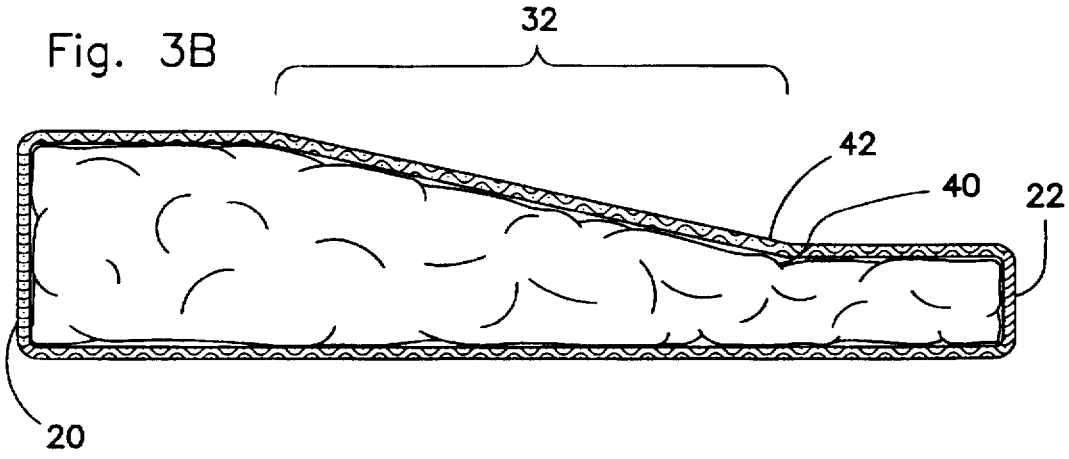
FIG. 3B is a cross sectional view of the blanket in which a continuous fill material has been employed.

Now that various topologies or configurations for the blanket have been illustrated, it can be seen that any of these configurations can be constructed in the manner according to FIG. 3A, or alternatively, according to FIG. 3B. The embodiment shown in FIG. 3B comprises an inner insulative block 40 and an outer covering 42. The inner insulative block 40 is made of any insulating material that is capable of being shaped according to the topologies shown in FIG. 4 through 7. With regard to FIG. 3B, the insulating block 40 has light 22 and heavy 20 sides. The transitional area 32 is formed between the light side 22 and heavy side 20. The variation in thickness in the transitional area 32 in this embodiment is even more linear than the embodiment of FIG. 3A that is formed by multiple layers 30.

In conclusion, herein is presented a blanket which provides varying degrees of insulation, so that a person can achieve maximum comfort by shifting their location beneath the blanket.

What is claimed is:

1. A blanket, having a blanket head and blanket foot comprising:

a light side, extending between the blanket head and blanket foot, having a light side insulation thickness;

a heavy side, extending between the blanket head and blanket foot, having a heavy side insulation thickness, wherein the heavy side insulation thickness is greater than the light side insulation thickness; and a transitional area, extending between the blanket head and blanket foot, located between the light side and heavy side, wherein the transitional area varies in insulation thickness between the light side insulation thickness and the heavy side insulation thickness wherein the blanket comprises at least five stacked layers, and wherein:

the light side is at least one layer thick;

the heavy side is at least five layers thick; and the layers from steps in the transitional area to create a uniform transition between the number of layers in the light side and the number of layers in the heavy side.

2. The blanket as recited in claim 1, wherein the blanket has a blanket foot and wherein the blanket further comprises straps, said straps located along the blanket foot and along the heavy side.

3. The blanket as recited in claim 3, having a light region between the light side and the transitional area, said light region having a uniform thickness.

4. The blanket as recited in claim 3, having a heavy region between the heavy side and the transitional area, said heavy region having a uniform thickness.

5. The blanket as recited in claim 4, having a light region between the light side and the transitional area, said light region having a uniform thickness.

* * * * *